United States Patent [19]

Leach, Sr.

[11] 4,393,668

[45] Jul. 19, 1983

[54] MANUAL KNITTING FRAME WITH SUPPORT

[76] Inventor: Clifford Leach, Sr., 1947 Woodglen La., #1, Vacaville, Calif. 95688

[21] Appl. No.: 294,679

[22] Filed: Aug. 20, 1981

[51] Int. Cl.[3] ..... D04B 3/00

[52] U.S. Cl. ..... 66/4

[58] Field of Search ..... 66/1, 1 A, 3, 4

[56] References Cited

U.S. PATENT DOCUMENTS

| | | | |
|---|---|---|---|
| 1,776,561 | 9/1930 | Croix | 66/4 |
| 2,072,668 | 3/1937 | Eltgroth | 66/4 |
| 2,450,067 | 9/1948 | Wolff | 66/4 |
| 2,691,878 | 10/1954 | Boxer | 66/4 |
| 3,967,467 | 7/1976 | Leach | 66/4 |

*Primary Examiner*—Ronald Feldbaum
*Attorney, Agent, or Firm*—Robert Keith Sharp

[57] ABSTRACT

A knitting frame comprising two spaced, flat, parallel bars having upstanding pins is provided with a support. The support includes a base plate, hook-shaped locking members rising from the base plate and curved sustaining members so spaced from the locking members that when one edge of one bar is against the locking members, the other edge will rest on the sustaining members in such a position that gravity will hold it against the locking members. The support also includes an upstanding knotting pin having notches in its top and sides. It is used to join yarn used in knitting.

6 Claims, 13 Drawing Figures

14
36
16
18
17
B
B
32
20
30
12

32
20
30

14
A
16
18
A
36
17
14
6
16
36
4
17

MANUAL KNITTING FRAME WITH SUPPORT

INTRODUCTION

This invention relates to a manual knitting frame combined with a support and a knotting device which makes the arrangement suitable for use with only one hand.

BACKGROUND

Manual knitting frames comprising two spaced parallel bars, each fitted with upstanding pins, are known in the art. One such knitting frame is shown in my U.S. Pat. No. 3,967,467. Yarn is laid in a zigzag manner between the pins in successive layers. The lower layer in then lifted over an upper layer by means of a pick. This accomplishes the knitting operation. Such frames are usually held in the lap or on a table and require the use of both hands to utilize the frame and carry out the knitting operation. Such frames have great utility in connection with occupational therapy, but an appreciable number of patients are able to use one hand and have been essentially prevented from use of the prior art frames. Furthermore, in knitting articles it is frequently necessary to knot together ends of two pieces of yarn. This operation has also required the use of two hands.

The object of this invention is to provide a manual knitting frame which is provided with an auxiliary support and an auxiliary knotting device so that it can be used by a person who is able to use only one hand, as well as by others.

SUMMARY OF THE INVENTION

This invention involves a manual kitting frame comprising two spaced parallel bars having upstanding pins thereon, such as is shown in my U.S. Pat. No. 3,967,467, in combination with a support. The support includes a plate having an upstanding hook-shaped locking member and an upstanding sustaining member spaced from the locking member by approximately the width of one of the bars of the knitting frame. The sustaining member is of such thickness that it will pass between the bars of the knitting frame. Preferably, two of each of these members are provided on the support, spaced apart by several inches. The support also carries an upstanding pin having a notch at the top and inclined notches on its sides. These notches are acutely angled so as to be capable of gripping yarn. The support in addition is provided with a threaded hole or other means for fastening to a tripod or other standard.

DETAILED DESCRIPTION

Figure 3:
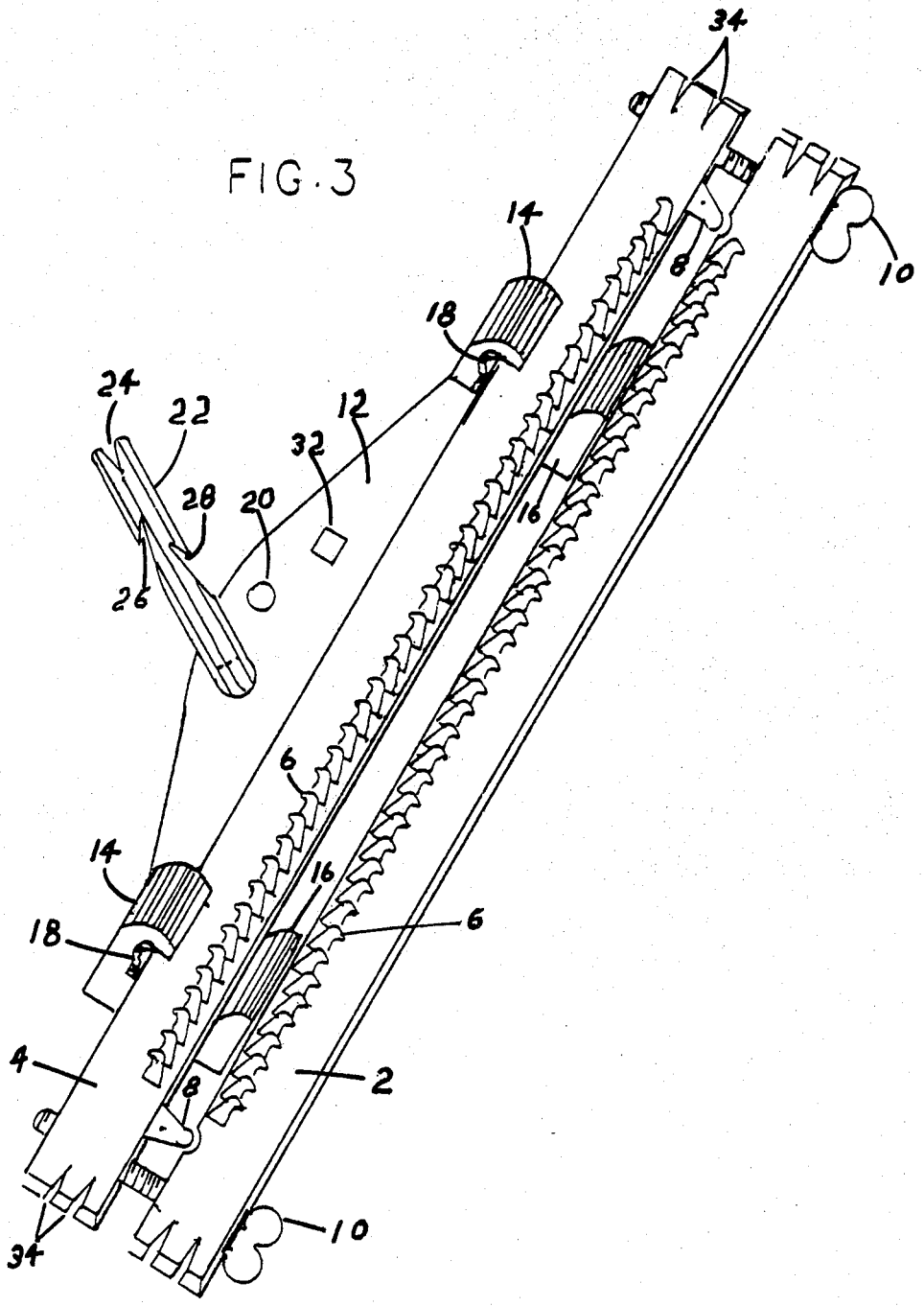
FIG. 3 is a perspective view showing the assembled combination of the knitting frame, support and knotting pin.

Referring first to FIG. 3, the knitting frame eomprises two pairs of spaced parallel bars 2 and 4. The top surfaces of the bars 2 and 4 lie in a single plane. Pins 6 are perpendicular to the plane formed by those surfaces. An adjustable spacer 8 at each end of the bars holds the bars apart while thumb screws 10 draw them together. The support, shown alone in FIG. 1, comprises a base plate 12. At each end of base plate 12 is a hook-shaped locking member 14 which is generally perpendicular to base plate 12. Spaced laterally relative to base plate 12 from each hook member 14 is a sustaining member 16 having an upper surface 17 curved upwardly from base plate 12 and away from locking member 14. The inner surface of each hook member 14 is preferably covered with an abrasive material 18. The surfaces of sustaining members 16, on the other hand, are smooth. The thickness of sustaining members 16 is such that they will pass between the bars 2 and 4, as shown in FIG. 3, when the bars are at their minimum spacing.

The base plate 12 is intended to be mounted on some auxiliary support member, as a tripod or table. I have shown it provided with a threaded opening 20 which would normally be made with a thread to fit on a standard camera tripod or similar tripod. However, the plate may be provided with other securing means, for example, a clamp, to enable it to be mounted on a table or in some other position. The plate 12 also carries an upstanding knotting pin 22 (FIG. 3) which is perpendicular to the plate and is provided with notches 24, 26 and 28. The knotting pin is shown and its operations illustrated in more detail in FIGS. 2 to 2H. I have shown plate 12 provided with a threaded hole 30 and a square hole 32 to receive a pin of the type shown in FIGS. 2 and that shown in FIG. 2H, respectively. In many cases it may be sufficient to simply choose one or the other shape and provide a single hole. However, each type of hole has certain advantages. The threaded hole provides greater security so that the support can be readily handled without danger of dropping the knotting peg out. However, the square opening provides for more definite orientation of the peg when in use. It may, therefore, be preferable, particularly in the case of supports supplied to institutions, to provide both types of holes so that either can be used, depending on the capabilities of the user.

Figures 1, 1A, 1B:
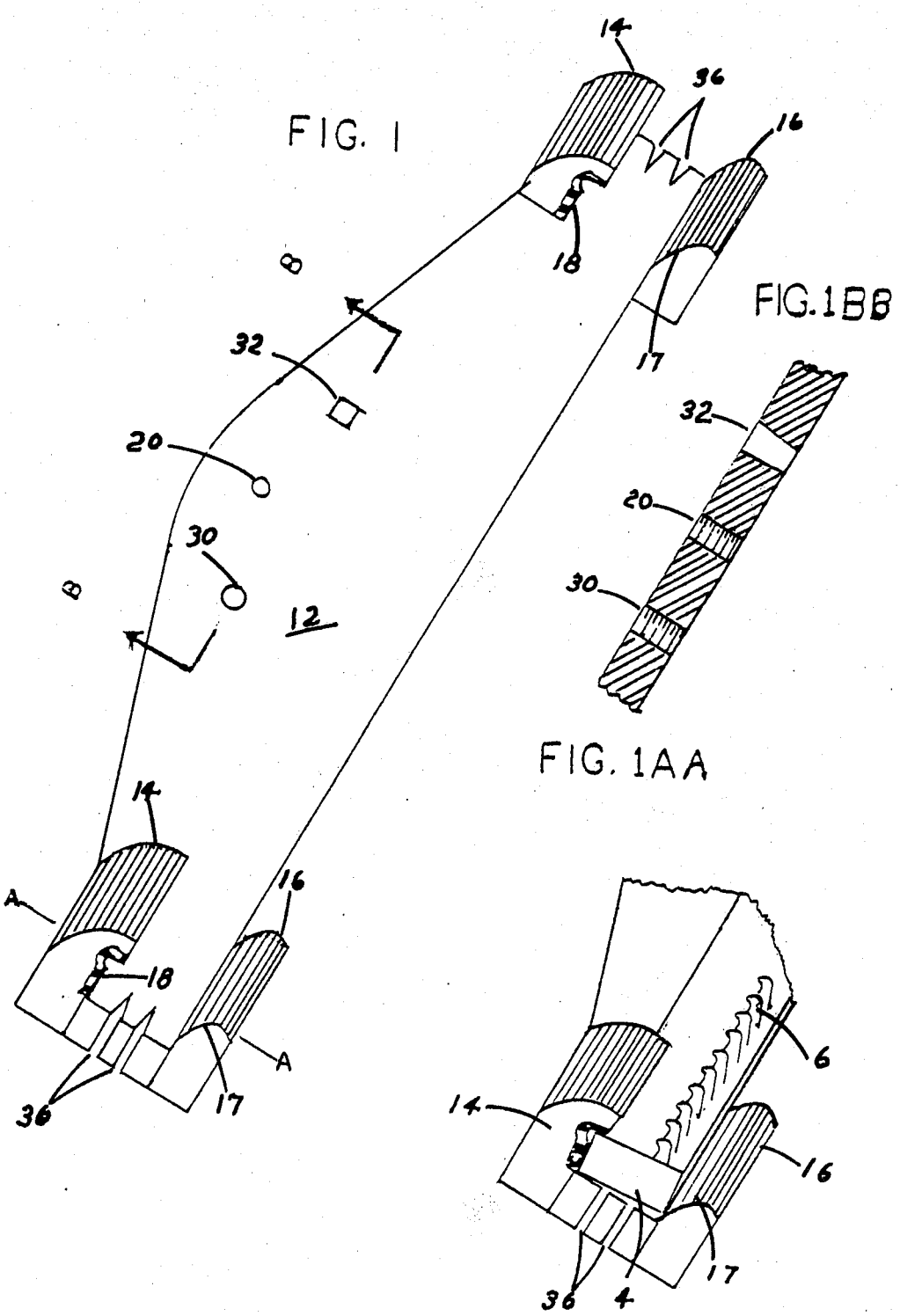
FIG. 1 is a perspective view showing the support member.
FIG. 1BB is a section taken on the line BB of FIG. 1.
FIG. 1AA is a partial perspective view showing the relation of the knitting frame to the support.

In order to mount the knitting frame on its support, the frame is tipped and inserted within the hooks of locking members 14, as shown in FIG. 1AA. The weight of the frame on sloping upper surfaces 17 of sustaining members 16 causes the frame to rest against abrasive surfaces 18 with sufficient force to permit use of the supported frame. It may be desirable to make these members 14 and 16 slightly springy so that the frame can be pushed down on sustaining member 16 until it is flat on plate 12 and is firmly locked in position.

The structure and operation of the knotting pin 22 will now be described in more detail. As mentioned above, the pin 22 contains notches 24, 26 and 28. It may be mentioned at this time that the bars 2 and 4 of the knitting frame itself are provided with notches 34 at each end, while the plate 12 of the support is provided with similar notches 36 at each end so shaped as to grip a piece of yarn when it is forced into them. In general I find an angle of about 10 degrees is satisfactory and the bottom surfaces of notches 26 and 28 are desirably inclined at about an angle of 12 degrees to the vertical axis of pin 22. It will be understood, of course, that these angles may be varied somewhat to accommodate yarn of different sizes.

Figure 2:
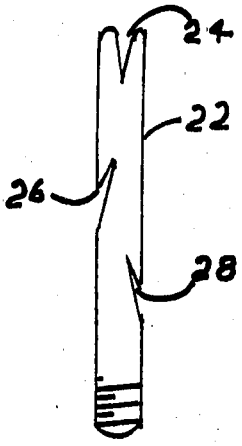
FIGS. 2 and 2H show two different modifications of the knotting pin.
Figure 2A:
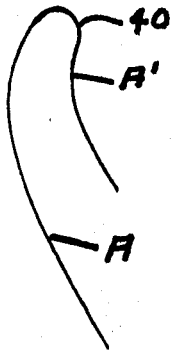
FIGS. 2A through 2G show the steps involved in the utilization of the knotting pin.
Figure 2B:
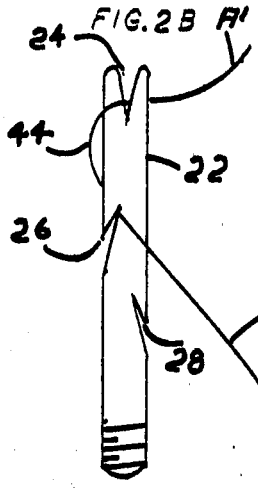
Figure 2C:
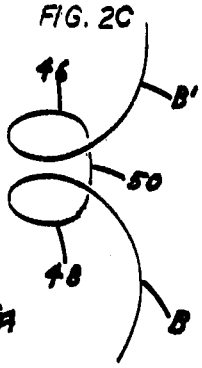
Figure 2D:
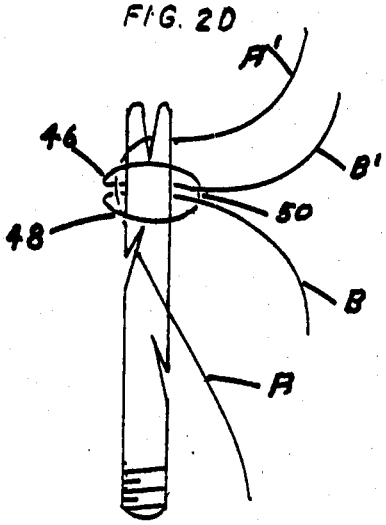
Figure 2E:
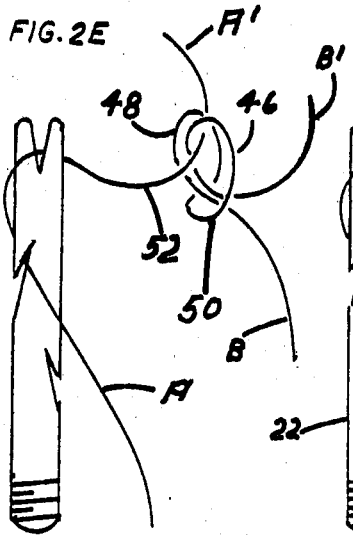
Figure 2F:
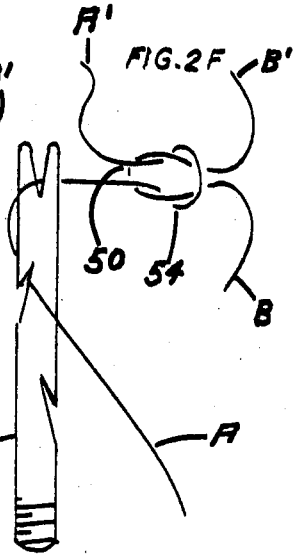
Figure 2G:
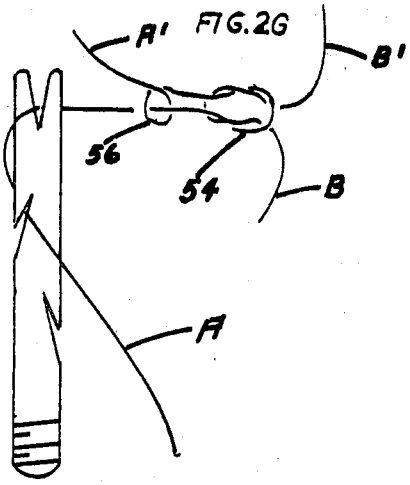
Figure 2H:
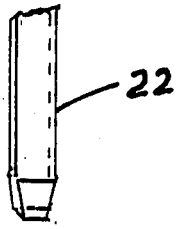

Referring now to FIGS. 2 and 2A, the yarn will be designated yarn A and yarn B, yarn A being that portion which is already in a knitted portion of the garment. Yarn B is a new length which is to be joined to it. Yarn A is first formed into a loop 40 as shown in FIG. 2A, leaving end A'. This loop is now passed over pin 22. If the person is right-handed, loop 40 will be drawn into notch 26. If he is left-handed, he will draw it into notch 28. The further description will be for the operation as performed by a right-handed person. After loop 40 is drawn into notch 26 the end A' of yarn A is wrapped a half turn 44 around pin 22 and end A' is pulled down into notch 24 at the top of pin 22 as shown in FIG. 2B. The above operations are done in such a manner as to leave at least 6 inches of yarn end A' extending beyond the pin. Yarn B is now laid on the lap of the operator or on a table and is formed into two loops, 46 and 48, which are connected by a length 50 (FIG. 2C). Loop 46 is then folded over on top of loop 48, using the length 50 as a hinge. The loops 46 and 48 are then laid over pin 22 and end A' is pulled out of these two loops, giving the arrangement shown in FIG. 2D. The two loops 46 and 48 are then lifted over the top of pin 22 and along length A' to the point 52, at which a junction is to be made, as shown in FIG. 2E. Length 50 is then pushed back over loops 46 and 48 onto end A'. This forms the square knot 54, as shown in FIG. 2F. The knot is then tightened by pulling yarn B and its projecting end, B', together. Yarn B and, if it is sufficiently long, its end B', are then pushed into one of the notches 34 of the knitting frame or one of notches 36 on the support. Bight or half hitch 56 is then formed from end A' about yarn A adjacent to knot 54 and pulled up tightly against that knot to stabilize it. Yarn ends A' and B' may then be cut off about $\frac{1}{8}$ inch from knot 54. Knitting may then be resumed.

In a typical embodiment of the support, the plate 12 is about 11 inches long and has a maximum width of about three inches and a thickness of $\frac{3}{8}$ inch. The sustaining members 16 are one inch long, $\frac{3}{8}$ inch thick at the base and 11/16 inch high, measured from the bottom of base plate 12. The upper surfaces 17 are curved away from locking member 14 on radii of $1\frac{1}{8}$ inch. The locking members 14 have the same heights, lengths and base thicknesses as the sustaining members. The inner surfaces rise vertically from base plate 12 for $\frac{1}{4}$ inch, then curve on radii of 3/16 inch toward the sustaining members. These inner surfaces are coated with abrasive. The distance between the bases of each sustaining member and its corresponding locking member is $\frac{3}{4}$ inch.

Knotting pin 22 is three inches high and $\frac{3}{8}$ inch in diameter. The notch 24 at the top has an angle of 10° and is symmetrical with respect to the vertical axis. The upper surfaces of notches 26 and 28 make angles of 25°, and the lower surfaces 12° with the vertical axis of pin 22. The threaded embodiment of pin 22 is provided with a 3/16 inch thread, while the square-based embodiment has lower end surfaces tapering downwardly and inwardly at angles of 10° to the vertical. Hole 20 in base plate 12 is provided with $\frac{1}{4}$ inch threads, to fit a standard tripod.

The entire support is made of a high-impact strength plastic.

As stated above, the support may be mounted on a standard camera tripod or other device. I have found a particularly convenient arrangement to be a commercial device having a weighted base provided with a suction plate for attaching it to a table top, a clamp having a spherical opening and a mating ball, to which is attached a short piece of flexible tubing terminating in a $\frac{1}{4}$ inch screw.

While I have described one embodiment in considerable detail, it will be understood that various changes can be made. I therefore wish my invention to be limited solely by the scope of the appended claims.

The embodiments of the invention in which a proprietary right or privilege are claimed are defined as follows:

1. In a knitting device, including a knitting frame comprising two spaced parallel bars, said bars having upper flat surfaces forming a plane and a row of pins substantially perpendicular to said plane on each of said bars; the improvement comprising a support for said frame, said support comprising a base plate, at least one upstanding hook-shaped locking member on said base plate, and at least one upstanding sustaining member on said base plate, said sustaining member being spaced from said locking member laterally of said base plate by a distance substantially the same as the width of one of said bars of said knitting frame, the hook of said locking member facing said sustaining member and the upper surface of said sustaining member being curved upwardly from said base plate and away from said locking member, said sustaining member being of such thickness that it will pass between the bars of said knitting frame, whereby said knitting frame can be laid on said support with one of said bars resting on said plate and within the hook of said locking member and against said sustaining member; and means for securing said support in a substantially fixed position.

2. A knitting device as defined in claim 1 comprising two of said locking members aligned longitudinally of said base plate, said locking members having their hooks curved laterally of said base plate and said sustaining member being spaced laterally from a line drawn between said locking members by substantially the width of one of the bars of said knitting frame.

3. A knitting device as defined in claim 2 and comprising two sustaining members, each of said sustaining members being positioned directly opposite one of said locking members.

4. A device as defined in claim 3 wherein the inner surfaces of said locking members are rough and the outer surfaces of said sustaining members are smooth.

5. A device as defined in claim 4 wherein said locking members and sustaining members are springy.

6. A knitting device as defined in claim 1 and further comprising a knotting pin mounted on said base plate substantially perpendicular to the plane of said base plate and comprising a notch in its top and a notch in at least one side, said notches being of such proportions as to grip a piece of yarn when it is forced into it, the notch in the side of said pin being inclined upwardly and at an acute angle to the vertical axis of said pin.

* * * * *